US009613559B2

(12) United States Patent
Kuijpers et al.

(10) Patent No.: US 9,613,559 B2
(45) Date of Patent: Apr. 4, 2017

(54) DISPLAYS WITH SEQUENTIAL DRIVE SCHEMES

(71) Applicant: KONINKLIJKE PHILIPS N.V., Eindhoven (NL)

(72) Inventors: Henricus Joseph Cornelus Kuijpers, Eindhoven (NL); Jan Van Der Horst, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 15/072,462

(22) Filed: Mar. 17, 2016

(65) Prior Publication Data

US 2016/0253945 A1 Sep. 1, 2016

Related U.S. Application Data

(63) Continuation of application No. 13/256,451, filed as application No. PCT/IB2010/051004 on Mar. 9, 2010, now abandoned.

(30) Foreign Application Priority Data

Mar. 17, 2009 (EP) ..... 09155332

(51) Int. Cl.
*G09G 5/10* (2006.01)
*G09G 3/20* (2006.01)
(Continued)

(52) U.S. Cl.
CPC ..... *G09G 3/2003* (2013.01); *G09G 3/003* (2013.01); *G09G 3/2074* (2013.01); *G09G 3/32* (2013.01);
(Continued)

(58) Field of Classification Search
CPC ..... G09G 2310/0235; G09G 3/3413; G09G 3/2003; G09G 3/3433; G09G 2320/0233; G09G 2320/0646; G09G 3/3607; G09G 5/02; G09G 2300/0452; G09G 3/3426; G09G 3/003; G09G 3/2074; G09G 3/32; G09G 3/36
See application file for complete search history.

(56) References Cited

U.S. PATENT DOCUMENTS 4,090,219 A 5/1978 Ernstoff et al.
4,600,274 A 7/1986 Morozumi
(Continued)

FOREIGN PATENT DOCUMENTS

CN 101290761 A 10/2008
CN 101291440 A 10/2008
(Continued)

*Primary Examiner* — Amare Mengistu
*Assistant Examiner* — Crystal A Mathews

(57) ABSTRACT

A method of driving a display uses first and second illumination cycles of the display. In each cycle, a first set of pixels is illuminated with a first color and a second set of pixels is illuminated with a second color. The first and second colors of the two cycles together include at least three colors for forming an image. This method provides a sequential drive scheme, in that at least two cycles are used with different color properties. However, each cycle uses at least two different colors, so that each cycle is not a single color across the whole display area. In this way, the color sequence is alternated spatially as well as temporally.

24 Claims, 4 Drawing Sheets

(51) Int. Cl.

| | |
|---|---|
| ***G09G 3/00*** | (2006.01) |
| ***G09G 3/34*** | (2006.01) |
| ***G09G 3/36*** | (2006.01) |
| ***G09G 3/32*** | (2016.01) |

(52) U.S. Cl.

CPC ..... *G09G 3/3413* (2013.01); *G09G 3/3426* (2013.01); *G09G 3/36* (2013.01); *G09G 3/3607* (2013.01); *G09G 2300/0452* (2013.01); *G09G 2310/0235* (2013.01); *G09G 2320/0242* (2013.01); *G09G 2320/0261* (2013.01)

(56) References Cited

U.S. PATENT DOCUMENTS

| | | | |
|---|---|---|---|
| 4,758,884 | A | 7/1988 | Roy |
| 5,969,850 | A | 10/1999 | Harrold et al. |
| 6,064,424 | A | 5/2000 | Van Berkel et al. |
| 6,069,650 | A | 5/2000 | Battersby |
| 6,859,256 | B2 | 2/2005 | Montgomery |
| 7,106,276 | B2 | 9/2006 | Akiyama |
| 7,397,484 | B2 | 7/2008 | Chang |
| 7,436,594 | B2 | 10/2008 | Van Berkel et al. |
| 7,629,988 | B2 | 12/2009 | Chung et al. |
| 7,852,313 | B2 | 12/2010 | Sekiguchi |
| 2002/0047592 | A1 | 4/2002 | De Zwart et al. |
| 2002/0057253 | A1 | 5/2002 | Lim et al. |
| 2002/0154215 | A1 | 10/2002 | Schechterman et al. |
| 2005/0001787 | A1 | 1/2005 | Montgomery et al. |
| 2005/0140636 | A1 | 6/2005 | Chung et al. |
| 2005/0237292 | A1 | 10/2005 | Kim et al. |
| 2006/0215128 | A1 | 9/2006 | Iwanaga |
| 2006/0232545 | A1 | 10/2006 | Sekiguchi |
| 2007/0103425 | A1 | 5/2007 | Tanaka et al. |
| 2007/0139352 | A1 | 6/2007 | Pugh |
| 2007/0146509 | A1 | 6/2007 | Hekstra |
| 2007/0165304 | A1 | 7/2007 | Tomita |
| 2007/0279374 | A1 | 12/2007 | Kimura et al. |
| 2007/0290217 | A1 | 12/2007 | Daniels |
| 2008/0036853 | A1 | 2/2008 | Shestak et al. |
| 2008/0198114 | A1 | 8/2008 | Roberts |
| 2008/0258997 | A1 | 10/2008 | Arai |
| 2008/0259099 | A1 | 10/2008 | Arai |
| 2008/0273005 | A1 | 11/2008 | Chen |
| 2009/0059581 | A1 | 3/2009 | Hayashi |
| 2009/0167788 | A1 | 7/2009 | Lin et al. |
| 2009/0295790 | A1 | 12/2009 | Pockett |
| 2010/0090937 | A1 | 4/2010 | Cheng et al. |
| 2010/0110114 | A1 | 5/2010 | Hashimoto |
| 2010/0165001 | A1 | 7/2010 | Savvateev et al. |
| 2010/0245406 | A1 | 9/2010 | Redert et al. |
| 2012/0007899 | A1 | 1/2012 | Kuijpers et al. |
| 2012/0212486 | A1 | 8/2012 | Van Der Horst et al. |

FOREIGN PATENT DOCUMENTS

| | | | |
|---|---|---|---|
| JP | 2002149129 | A | 5/2002 |
| JP | 200510510 | A | 1/2005 |
| JP | 2008268324 | A | 11/2008 |
| WO | 2007024118 | A1 | 3/2007 |
| WO | 2007069106 | | 6/2007 |
| WO | 2008033512 | A2 | 3/2008 |
| WO | 2008100605 | A2 | 8/2008 |

DISPLAYS WITH SEQUENTIAL DRIVE SCHEMES

This application is a continuation of U.S. patent application Ser. No. 13/256,451, and claims the benefit of PCT/IB10/51004, filed 9 Mar. 2010, and EP09155332.1, filed 17 Mar. 2009.

FIELD OF THE INVENTION

This invention relates to pixellated displays with sequential drive schemes, for example active matrix liquid crystal displays which use a sequential drive scheme to provide a color output.

BACKGROUND OF THE INVENTION

Active matrix liquid crystal displays (AMLCDs) typically generate colored images by providing pixels which consist of three separate dots, each of which has a color filter transmitting one primary color. These dots usually cover an area of one third of a full pixel and are generally referred to as sub-pixels of the full pixel. As a result of limitations in process and design of the dots, the aperture for transmitted light is reduced in AMLCD displays resulting either in low brightness or high power in the backlight.

An alternative method for generating colored images is to have just one dot per pixel space, and sequentially flash the backlight within one image buildup period with the three color primaries, where the image build up period is the time in which all image information is output by the display such that a viewer is able to observe a full color image. This creates what is known as a color sequential display. The liquid crystal pixel can then sequentially control the amount of each primary color transmitted. Because the sequential flashing occurs quickly, the eye will integrate the light of one image buildup period such as to perceive a full color image.

A similar display technology is known as spectrum sequential display, and this technology only requires that the backlight is flashed twice per image buildup period. Color is then generated by each backlight flash in the form of two primaries (for example blue and yellow in the first sub-frame and cyan and red in the second sub-frame). Each pixel is divided into two dots and each dot has a color filter which transmits one primary from each flash of the backlight (for example blue and cyan for the first dot and yellow and red for the second dot). This approach thus provides a compromise between the time available for each flash of the backlight and the size of each pixel dot.

The two approaches above each rely upon flashing of the backlight, and the desired color for each pixel is built up as a sequence of color outputs. These two approaches can both be described as a "sequential drive scheme".

One advantage of a sequential drive scheme is that the resolution can be increased compared to a standard display, because there need only be one or two sub-pixels per pixel.

This increase in resolution is of general interest for LCD displays, but is of particular interest for autostereoscopic display devices, in which a display panel has an array of display pixels for producing a display, and a plurality of imaging means, such as lenticular elements or semi-transparent barriers, arranged over the display panel and through which the display pixels are viewed. Taking a display having lenticulars as an example for explaining the working principle of such view directing means, the lenticular elements are typically provided as a sheet of lenticular elements (lenticulars), each of which comprises an elongate lens element that may have a desired lens shape such as elliptical or semi-cylindrical. The lenticular elements extend in the column direction of the display panel (or slanted with respect to the column direction), with each lenticular element overlying a respective group of two or more adjacent columns of display pixels or sub-pixels. In an arrangement in which, for example, each lenticule is associated with two columns of display pixels (no slant angle), the display pixels in each column provide a vertical slice of a respective two dimensional sub-image, i.e. multiple views are directed into multiple directions. The lenticular sheet directs these two slices and corresponding slices from the display pixel columns associated with the other lenticules, to the left and right eye of a user positioned in front of the sheet, so that the user observes a single stereoscopic image. The sheet of lenticular elements (and each lenticular element) thus provides a light output directing function such that light output intended for the left and right eye is directed into two different views or view directions.

In other arrangements, each lenticule is associated with a group of more than two adjacent display pixels in the row direction. Corresponding columns of display pixels in each group are arranged appropriately to provide a vertical slice from a respective two dimensional sub-image. As a user's head is moved from left to right across a display a series of successive, different, stereoscopic views are perceived creating, for example, a look-around impression. A detailed explanation of the working principle including slanting of the lens to achieve certain improvements is provided hereinafter and for example in U.S. Pat. No. 6,069,650.

The above described device provides an effective three dimensional display. However, it will be appreciated that, in order to provide stereoscopic views, there is a necessary sacrifice in the resolution of the device, as different sets of display pixels are associated with different views. This sacrifice in resolution is unacceptable for certain applications, such as the display of small text characters for viewing from short distances. For this reason, it has been proposed to provide a display device that is switchable between a two-dimensional mode and a three-dimensional (stereoscopic) mode. However, this fails to address the problem of the loss of resolution in the 3D mode.

It will be seen that the use of a sequential drive scheme can restore some of the loss of resolution. In addition, by reducing the amount of filtering, the efficiency is improved. When color filtered pixels are used, the efficiency is reduced by roughly 67%.

Although sequential drive schemes can improve resolution and efficiency, a problem is the occurrence of color break-up, also known as the "rainbow effect". This is the effect that the color visibility at different moments becomes visible by high motion of the displayed image and/or by high motion of the viewer (eyes). In most cases this artefact is perceived as very disturbing.

SUMMARY OF THE INVENTION

According to the invention, there is provided a method of driving a display having output pixels each of which is capable of providing a light output of at least a first and a second color different from the first color, the first and second colors being selected from a group of three different colors, the method comprising:

performing first and second illumination cycles of the display in sequence, wherein each illumination cycle comprises illuminating the pixels (45) of the display with at least a first set of pixels being illuminated with a first color and a second set of pixels illuminated with a second color, wherein the first and second colors of the two cycles together include all three colors of the group for forming an image.

This method provides a sequential drive scheme, in that at least two cycles are used with color properties. However, each cycle uses at least two different colors, so that each cycle is not a single color across the whole display area. In this way, the color sequence is alternated spatially as well as temporally. The spatial alternation period can be within individual pixels (i.e. different sub-pixels have different colors) or it can be on a larger scale (i.e. groups of adjacent pixels have the same color in a given cycle).

Preferably, all pixels are illuminated in each illumination cycle, although this is not essential.

The method can be for driving a liquid crystal display, wherein each display cycle comprises illuminating the display using a backlight. In this case the liquid crystal cells function as individually addressable shutters that are sequentially illuminated with the required colors.

In one arrangement, both (or all if there are more than 2) cycles can have all colors, but at a fraction of the resolution (e.g. ⅓). All cycles when combined reconstruct the total resolution. In this way, when high motion exists in the displayed image or the viewer's eyes are moving, a lower resolution of the image is perceived (i.e. resolution break-up) instead of the annoying color break-up.

In one arrangement, the first and second colors of the first cycle comprise two of red, green and blue, and the first and second colors of the second cycle comprise two of red, green and blue. There can then be only two cycles, which together provide the three required colors (one color provided twice). This represents an increase in resolution of 150% (each pixel has two sub-pixels instead of three), and the two sub-frames are required.

The first and second colors of one cycle can comprise red and green and the first and second colors of the other cycle 1. This corresponds to a 4:2:2 color resolution.

In another arrangement, there are at least three illumination cycles, wherein during the first, second and third illumination cycles, the pixels are illuminated with a first set of pixels being illuminated with a respective first color, a second set of pixels illuminated with a respective second color and a third set of pixels illuminated with a respective third color.

This arrangement provides all three colors during each cycle, and requires (at least) three cycles. This can increase the resolution to 300% with the area corresponding to a sub-pixel of a conventional display functioning as a color pixel. The first to at least third cycles comprise a group of cycles corresponding to a frame period of the display, and in each group of cycles, each pixel is illuminated at least once with red, green and blue.

Providing different color illumination to different pixels can comprise using a colored light source to illuminate a directing arrangement which directs light to a predetermined set of pixels. This requires a patterned directing arrangement rather than a patterned backlight.

Alternatively, providing different color illumination to different pixels can comprise using discrete light sources behind the display to illuminate respective predetermined sets of pixels of the display.

In one arrangement, the pixels have a 3:1 height to width aspect ratio. The color pattern in each cycle can then be arranged as a repeating pattern in the row direction. The method is of particular interest for driving an autostereoscopic display. Such a display may be a liquid crystal display.

The invention also provides a display drive circuit for driving each pixel of a display in cycles, wherein the display has output pixels each of which is capable of providing a light output of at least a first and a second color different from the first color, the first and second colors being selected from a group of three different colors, wherein the circuit comprises means for controlling the display such that:

during each of at least first and second illumination cycles, the pixels are illuminated with at least a first set of pixels being illuminated with a respective first color and a second set of pixels being illuminated with a respective second color, wherein the first and second colors of the two cycles together include all three colors of the group for forming an image.

In one example, drive signals are provided to the pixels in synchronism with a backlight control, such that each pixel is addressed by a group of illumination cycles.

The invention also provides a display comprising: an array (43) of pixels, and a drive circuit according to the invention.

The pixels of the display according to the invention may comprise an array of liquid crystal pixels, and the display can further comprise a backlight arrangement (for illuminating the liquid crystal pixels, and wherein the means for controlling the display is for controlling the backlight, wherein each illumination cycle comprises illuminating the display using the backlight.

The display may be an autostereoscopic display for providing autostereoscopic images. The display, for this purpose may further comprise a view directing arrangement overlaying at least part of the pixels for directing the output of the pixels it overlays into different directions such that a viewer experiences a stereoscopic image.

In one example of such an autostereoscopic display the view directing arrangement comprises a parallax barrier which may be (but need not necessarily be) shaped such that it has non-transparent stripes and transparent slits that are elongate with their elongate axis parallel or slanted with a slant angle with respect to the pixel column direction. Further structural features are defined in the detailed description here below referring to specific disclosures of such displays.

In another and preferred embodiment, the view directing arrangement takes the form of lenticular elements that overly the pixels. The lenticular elements may be semi-curved (cylindrical elements) having a long optical axis parallel or slanted with some specific slant angel to the pixel column direction. Each lenticular element then overlies a respective group (set) of two or more adjacent columns of display pixels.

BRIEF DESCRIPTION OF THE DRAWINGS

Examples of the invention will now be described in detail with reference to the accompanying drawings, in which.

DETAILED DESCRIPTION OF EMBODIMENTS

The invention provides amongst others a sequential drive scheme comprising multiple drive cycles performed sequentially in time, in which multiple colors are provided in each drive cycle such that different colors are provided to different pixels within different cycles. Over the full number of cycles making up an addressing period, each pixel is illuminated by all three required colors. There can be a single pixel element per pixel—illuminated three times in three different colors, or there can be two sub-pixel elements per pixel—illuminated twice so that the three different colors are represented in the two sub-pixels. In this way, the color sequence is alternated spatially as well as temporally.

Figure 1A:
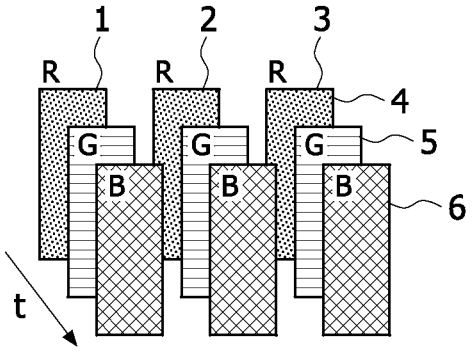
FIG. 1A shows schematically the known sequential drive scheme.
Figure 1B:
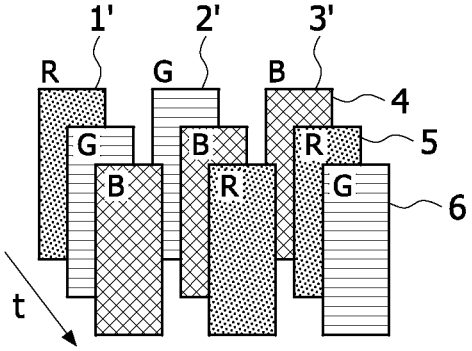
FIG. 1B shows an example of sequential drive scheme according to the invention.

FIG. 1B illustrates schematically one example of approach of the invention in comparison with a standard color sequential LCD drive scheme shown in FIG. 1A. FIG. 1A shows three sub-pixels 1, 2 and 3 of a pixel illuminated in drive cycles 4 5 and 6 sequentially in time and thus in turn with red (R), green (G) and blue (B) as represented by the rectangles along the time axis (t). Each of the drive cycles 4, 5 and 6 uses a single color, i.e. results in illumination of all sub-pixels 1, 2 and 3 with one color simultaneously in one cycle. This is the conventional arrangement, in which the display resolution is maximized, with one sub-pixel element (one rectangle in the image) being driven as a single pixel, but over three sequential cycles. FIG. 1B shows three sub-pixels 1', 2' and 3' of a pixel illuminated again like in FIG. 1A in turn with red (R), green (G) and blue (B). However, now the colors are spatially interleaved. Thus, each cycle 4, 5 and 6 uses each color for different pixels (or set of pixels if applicable). Again, the display resolution is maximized, with one sub-pixel element (one rectangle in the image) being driven as a single pixel, but over three sequential cycles. Thus, within one cycle multiple colors are output instead of only one as in FIG. 1A. One advantage is that in response to rapid movement (of the image or the viewer), the loss in image quality is seen as resolution break up rather than color break up, and this has been found to be significantly less distracting to the viewer.

This approach is particularly suitable for standard 3:1 pixel dimensions. The spatial pattern in each illumination cycle comprises alternation with a period of three sub-pixels in the row direction. This looks like a standard LCD panel where a pixel triplet alternates between RGB, GBR and BRG configurations over time.

Figure 1C:
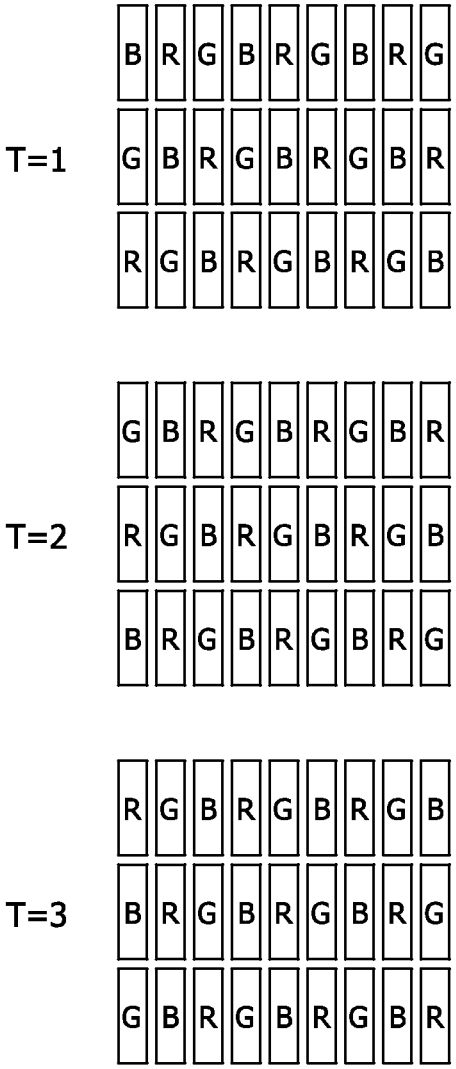
FIG. 1C shows an example of sequential drive scheme according to the invention.

This is illustrated in FIG. 1C, which shows the three cycles (T=1 to 3) corresponding to the arrangement of FIG. 1B.

There are however numerous other possible implementations of the method of interleaving.

A partial color sequential display can also be implemented, for example with only red and blue interleaved in time and position, with only two cycles. In this way, a balance is created between color break-up and resolution break-up and the resolution gain is limited to 150% instead of 300%. A form of inverted spatial positioning can then be used, for example RGB in one cycle and BGR in the other cycle.

The invention requires the backlight output to be patterned, with different colors applied to different pixels.

Figure 2:
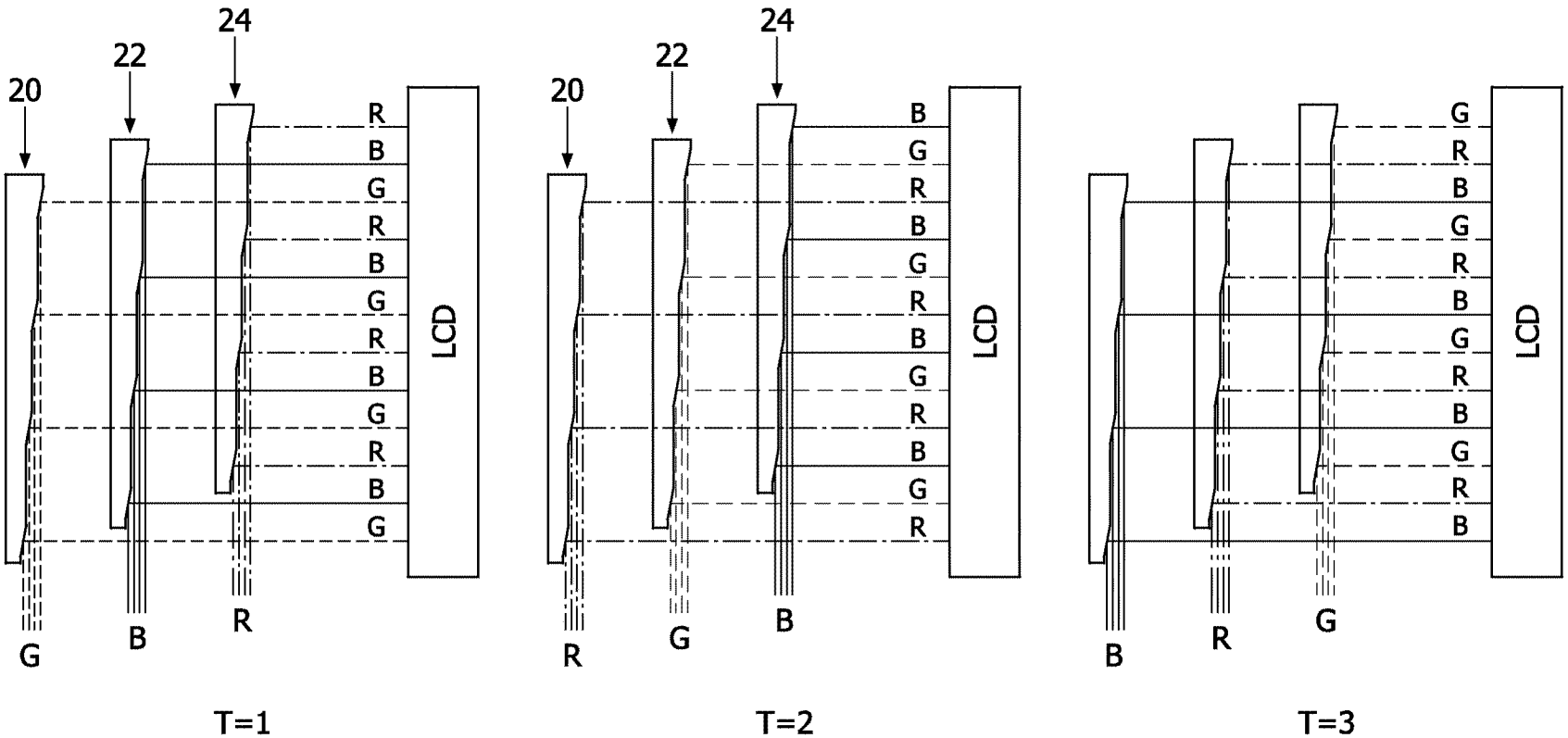
FIG. 2 shows one example of how to implement the backlight to enable the drive scheme of the invention.

One way to implement this is shown in FIG. 2, in which the pixels do not have color filters themselves. The display has a backlight arrangement that can generate three colors. There are three pixel patterns, and a light directing arrangement 20,22,24 is associated with each pixel pattern. In a first cycle (T=1), green light (G) is provided to the first light directing arrangement 20, blue light (B) is provided to the second light directing arrangement 22 and red light (R) is provided to the third light directing arrangement 24. In a second cycle (T=2), red light (R) is provided to the first light directing arrangement 20, green light (G) is provided to the second light directing arrangement 22 and blue light (B) is provided to the third light directing arrangement 24. In a third cycle (T=3), blue light (B) is provided to the first light directing arrangement 20, red light (R) is provided to the second light directing arrangement 22 and green light (G) is provided to the third light directing arrangement 24.

The light directing arrangements can comprise lightguides which direct collimated light to the LCD panel.

One example of arrangement for providing light to the lightguides is a set of RGB LED systems. One such RGB LED system is provided for each cycle, so that for the example of FIG. 2, there are three separate RGB LED light systems. Each of these is controllable to output red, green or blue light as desired. Each LED light system is coupled to a respective lightguide arrangement at the side of the display.

The lightguide arrangement can comprise optical fiber bundles which together terminate in an array corresponding to the pixel array. As can be seen from FIG. 2, each optical fiber bundle terminates in a set of positions corresponding to a sub-array of pixels, namely a sub-array of pixels which will always be illuminated with the same color at any given time.

Figure 3:
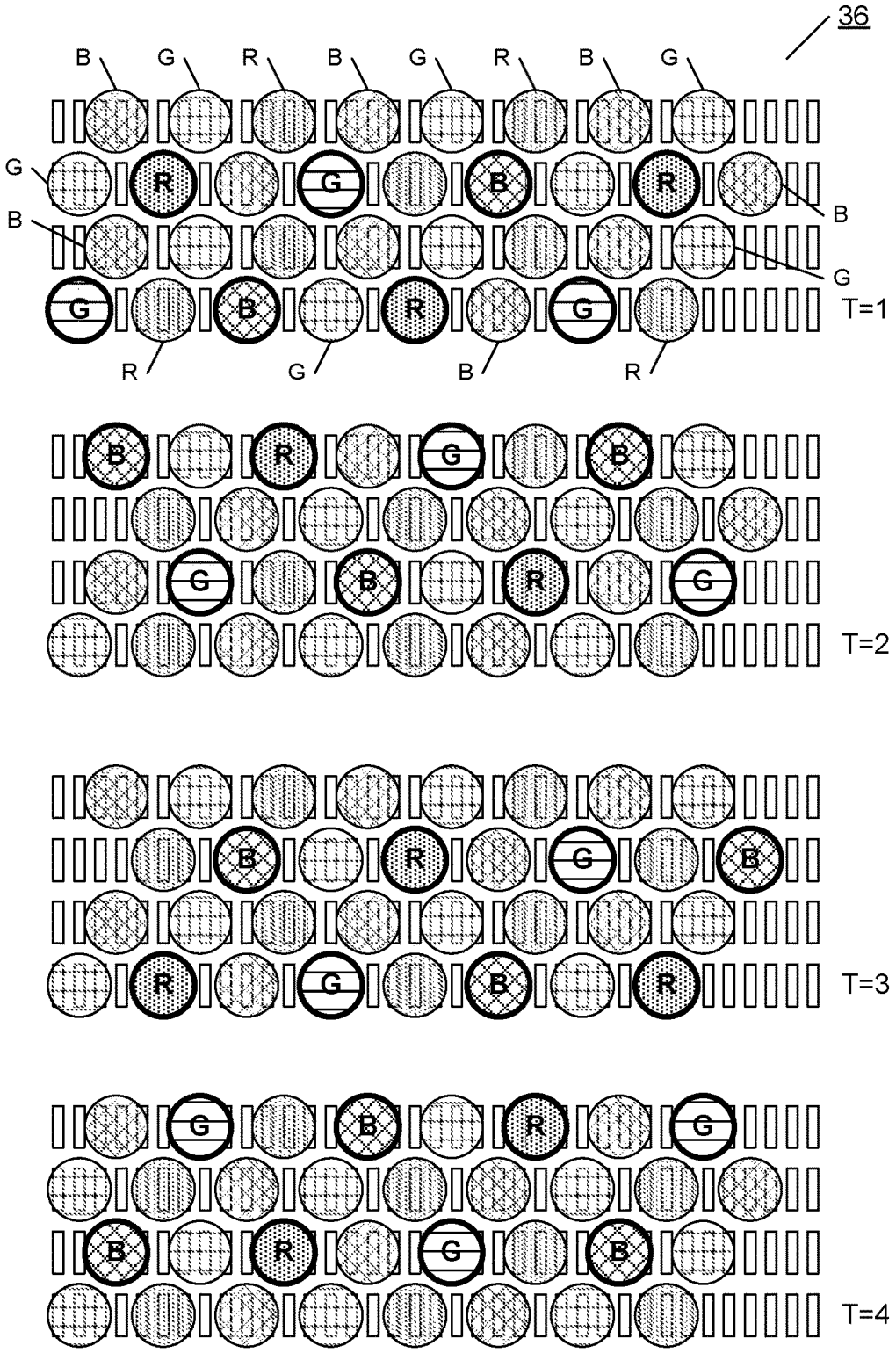
FIG. 3 shows a second example of drive scheme using a second example of backlight arrangement.

FIG. 3 shows an arrangement in which an array of small RGB LEDs is placed behind the LCD panel. These RGB LEDs are turned on in a time-sequential manner. Different groups of LEDs are used in each cycle, so that there is spatial separation. The spatial separation occurs at a larger scale, for example every five pixels.

The rectangles in FIG. 3 represent the pixels and the circles represent the LEDs, with filled circles representing LEDs that are turned on, and the letter R, G, B indicating the color.

A four-cycle scheme is shown (T=1 to T=4). Each LED will illuminate a ring of pixels, with decreasing intensity further from the LED centre. Processing can cope with the exact light distribution of the LED-light projected on the LCD. Thus, the set of illuminated light sources can be considered to illuminate all (sub) pixels. During each cycle, the same number of LEDs are illuminated (for each pair of alternate rows, one row is not illuminated and half of the LEDs of the other row are illuminated, giving ¼ of the LEDs per cycle).

FIG. 3 is a Delta-Nabla LED distribution behind the LCD. Simpler configurations are possible, but this particular configuration, has a circular spatial frequency response achieving good compatibility with the round form of the LED backlights and also providing optimal homogeneity of the formed low resolution color grid. Each LED is illuminated only once in the four cycles, but during each cycle, all pixels are illuminated, albeit with different intensities.

Figure 4:
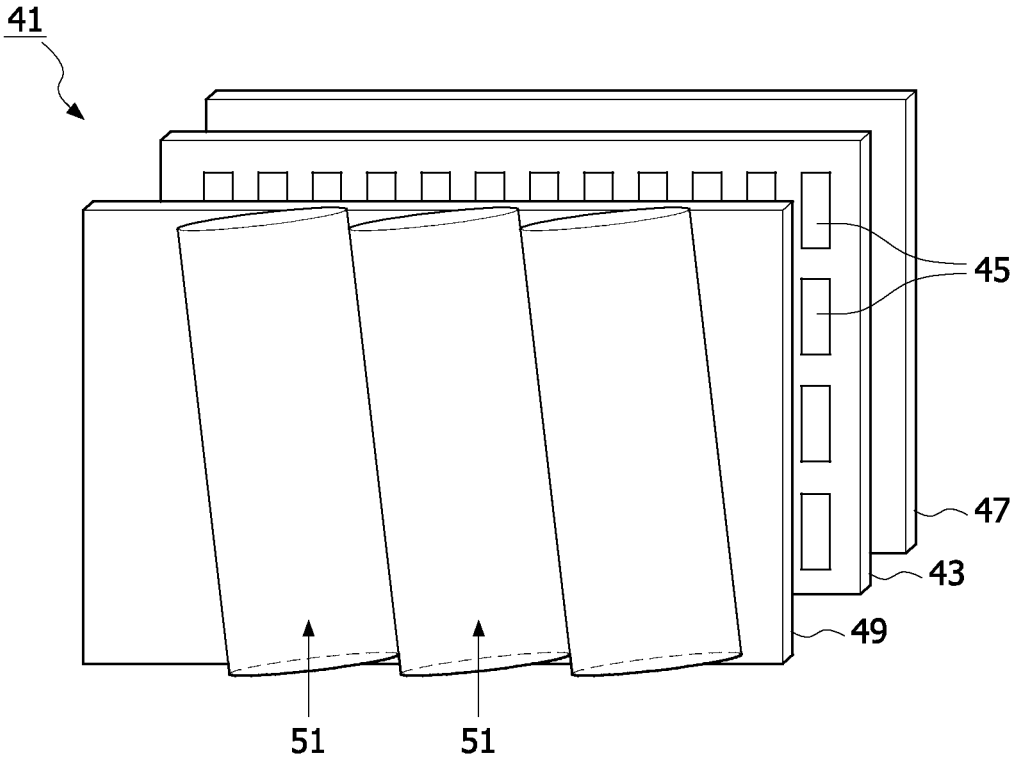
FIG. 4 is used to explain the operation of an autostereoscopic display device to which the invention can be applied.

The invention is of particular interest for autostereoscopic displays. FIG. 4 is a schematic perspective view of a known direct view autostereoscopic display device 41. The known device 41 comprises a liquid crystal display panel 43 of the active matrix type that acts as a spatial light modulator to produce the display.

The display panel 43 has an orthogonal array of the display pixels 45 arranged in rows and columns. For the sake of clarity, only a small number of display pixels 45 are shown in the FIG. 4. In practice, the display panel 43 might comprise about one thousand rows and several thousand columns of display pixels 45.

The structure of the liquid crystal display panel 43 is entirely conventional. In particular, the panel 43 comprises a pair of spaced transparent glass substrates, between which an aligned twisted nematic or other liquid crystal material is provided. The substrates carry patterns of transparent indium tin oxide (ITO) electrodes on their facing surfaces. Polarizing layers are also provided on the outer surfaces of the substrates.

In one example, each display pixel 45 comprises opposing electrodes on the substrates, with the intervening liquid crystal material therebetween. The shape and layout of the display pixels 45 are determined by the shape and layout of the electrodes. The display pixels 45 are regularly spaced from one another by gaps.

Each display pixel 45 is associated with a switching element, such as a thin film transistor (TFT) or thin film diode (TFD). The display pixels are operated to produce the display by providing addressing signals to the switching elements, and suitable addressing schemes will be known to those skilled in the art.

The display panel 43 is illuminated by a light source 47. In a conventional arrangement, this comprises a planar backlight extending over the area of the display pixel array. Light from the light source 47 is directed through the display panel 43, with the individual display pixels 45 being driven to modulate the light and produce the display.

The display device 41 also comprises a lenticular sheet 49, arranged over the display side of the display panel 43, which performs a view forming function. The lenticular sheet 49 comprises a row of lenticular elements 51 extending parallel to one another, of which only one is shown with exaggerated dimensions for the sake of clarity.

The lenticular elements 51 are in the form of convex cylindrical lenses (but other shapes such as elliptical etc may equally well be used without loss of the effect of the invention), and they act as a light output directing means to provide different images, or views, from the display panel 43 to the eyes of a user positioned in front of the display device 41.

The autostereoscopic display device 41 shown in FIG. 4 is capable of providing several different perspective views in different directions. In particular, each lenticular element 51 overlies a small group of display pixels 45 in each row. The lenticular element 51 projects each display pixel 45 of a group in a different direction, so as to form the several different views. As the user's head moves from left to right, his/her eyes will receive different ones of the several views, in turn.

In the present example, the application of the invention has been described in relation to an autostereoscopic display that uses a lenticular sheet as the view directing means. Although that is a preferred option with respect to for example display brightness, the invention is equally well applicable to autostereoscopic displays that have parallax barriers as the view directing means, or even other autostereoscopic displays that direct the parallactic output of different pixels into different views that when perceived by a viewer result in the viewer to experience stereoscopic or even look around display of images video etc. In the parallax barrier based autostereoscopic displays the view directing means takes the form of a parallax barrier instead of a lenticular, which, in essence, is a sheet having in alternating fashion transparent and non-transparent parallel stripes. In the display, the sheet is oriented such that the stripes extend, just like the lenticulars of a lenticular autostereoscopic display, in the pixel column direction. In this way output of pixels may pass through the transparent stripes between the non-transparent stripes while they are blocked by the non-transparent stripes (barriers). In this manner, output of certain pixels is directed into certain directions representing the view directions (views). The exact directions in which output is provided by a display depends on amongst others the pitch of the alternating stripes with respect to the pixel pitch as well as the distance of the sheet to the pixel plane and the lateral position of transparent parts of the sheet with respect to pixels. More detailed description of the operation of and general construction of a parallax barrier autostereoscopic display is given in for example U.S. Pat. No. 715,463 (incorporated by reference), which by description of FIGS. 1 to 3 therein provide the construction of an example of such a display. Another example is provided in the description of U.S. Pat. No. 6,859,256 or WO2007/024118 (both incorporated by reference). Many more examples of such displays have been described to which the current invention may be applied with its advantageous effects as described here before.

The conventional arrangement of FIG. 4 can be amended in accordance with the invention by modifying the backlight and the control of the pixel outputs in the manner explained above.

For an autostereoscopic display, the invention enables higher 3D resolutions and depth perception. This is due to the fact that the different colors of a particular view can be sent out to the viewer sequentially, thus not requiring spatially different pixels. Hence less spatially distributed pixels are used for defining one image point of a view. At the same time the advantages as described here before are achieved. For 2D displays, the invention improves efficiency and enables improved brightness and color gamut.

Figure 5:
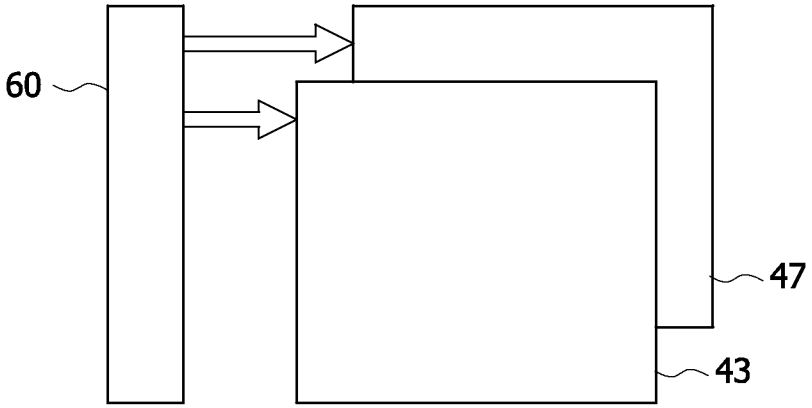
FIG. 5 shows a display arrangement of the invention.

FIG. 5 shows a display device of the invention. A display drive circuit 60 is provided for driving each pixel of the pixel array 43 display in the cycles as explained above, and also controls the backlight 47.

The pixel array 43 can be part of a 2D LCD system or a 3D autostereoscopic display. The drive circuit implements the conventional LCD drive functions, but additionally synchronizes the pixel drive with the backlight illumination. The implementation of the LCD drive circuit will be completely routine to those skilled in the art. Thus, the drive circuit may be built according to conventional electronics and preferably from microelectronics or semiconductor electronic chips such that it in effect is a computer. The software for steering such driving devices may be contained within an internal memory of such a driving circuit or may be contained on separate appropriate software carriers such as electronic memory (magnetic hard disc, solid state memory) or optical memory like DC-ROM DVD or others that may be connected to or inserted in the drive circuit.

The examples above use a liquid crystal display. The described embodiment serves to exemplify the operation of the invention. However, the advantages of the invention can be obtained when other illuminated display technologies are employed. It will be appreciated that the improvements or advantages of the invention are provided to all displays that have the pixels with the defined requirements. These need not be LCD defined/based pixels. Thus, a display that has pixels capable of emitting multiple distinct colors or color spectra sequentially may be used. Furthermore, the invention applies to any display arrangement which uses an illumination source and a shutter-type pixellated display. An LCD may be seen as an example of a shutter type pixellated display.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measured cannot be used to advantage. A computer program may be stored/distributed on a suitable medium, such as an optical storage medium or a solid-state medium supplied together with or as part of other hardware, but may also be distributed in other forms, such as via the Internet or other wired or wireless telecommunication systems. Any reference signs in the claims should not be construed as limiting the scope.

The invention claimed is:

1. A method of driving a display that includes a plurality of pixels comprising:

displaying a frame of an image by displaying two luminance cycles, each luminance cycle comprising a concurrent illumination of only two colors;

wherein a first luminance cycle includes concurrently illuminating a first set of pixels to produce a first color, and a second set of pixels to produce a second color;

wherein the first color and second color are different and selected from the group consisting of red, blue, and green;

wherein a second luminance cycle includes concurrently illuminating a third set of pixels to produce a third color, and a fourth set of pixels to produce a fourth color, wherein the third color and fourth color are different and selected from the group consisting of red, blue, and green; and wherein the first, second, third, and fourth colors together include red, blue, and green.

2. The method of claim 1, wherein the third set of pixels corresponds to the first set of pixels and the fourth set of pixels corresponds to the second set of pixels.

3. The method of claim 2, wherein pixels of the first set of pixels and the second set of pixels are alternately interlaced across a row of pixels of the display.

4. The method of claim 1, wherein the first and second colors include blue and green and the third and fourth colors include red and green.

5. A display comprising:

an array of pixels;

a first light directing arrangement that provides a first color;

a second light directing arrangement that provides a second color;

a third light directing arrangement that provides a third color; and a controller that controls the first, second, and third light directing arrangements to illuminate select pixels of the display for each frame forming an image;

wherein each of the first, second, and third colors are different from each other;

wherein during a first illuminance cycle of the frame, the controller:

controls the first light directing arrangement to illuminate a first set of pixels, controls the second light directing arrangement to illuminate a second set of pixels, and controls the third light directing arrangement to not illuminate any pixels; and wherein during a second illuminance cycle of the frame, the controller:

controls the first light directing arrangement to not illuminate any pixels, controls the second light directing arrangement to illuminate a third set of pixels, and controls the third light directing arrangement to illuminate a fourth set of pixels.

6. The display of claim 5, wherein the third set of pixels corresponds to the first set of pixels and the fourth set of pixels corresponds to the second set of pixels.

7. The device of claim 6, wherein pixels of the first set of pixels and the second set of pixels are alternately interlaced across a row of pixels of the display.

8. The display of claim 5, wherein the first, second, and third colors together include red, green, and blue, respectively.

9. The display of claim 5, wherein the array of pixels includes elements of a liquid crystal display.

10. The display of claim 9, including a lenticular sheet arranged over a light output surface of the liquid crystal display.

11. The display of claim 5, wherein the first, second, and third light directing arrangements include a plurality of light emitting devices (LEDs) and a plurality of lightguides that provide collimated light to the plurality of pixels.

12. A display comprising:

an array of pixels that includes a first set of pixels and a second set of pixels, the first and second set comprising all of the pixels of the display;

a first light directing arrangement that provides a first select color to the first set of pixels;

a second light directing arrangement that provides a second select color to the second set of pixels; and a controller that controls the first and second light directing arrangements to illuminate the first and second sets of pixels of the display for each frame forming an image;

wherein during a first illuminance cycle of the frame, the controller:

controls the first light directing arrangement to illuminate the first set of pixels with a first color, and controls the second light directing arrangement to illuminate the second set of pixels with a second color; and wherein during a second illuminance cycle of the frame, the controller:

controls the first light directing arrangement to illuminate the first set of pixels with one of the second color and a third color, and controls the second light directing arrangement to illuminate the second set of pixels with one of the second color and the third color that is not illuminating the first set of pixels;

wherein each of the first, second, and third color is different from each other.

13. The display of claim 12, wherein the first, second, and third colors are red, green, and blue, respectively.

14. The device of claim 12, wherein pixels of the first set of pixels and the second set of pixels are alternately interlaced across a row of pixels of the display.

15. The display of claim 12, wherein the array of pixels includes elements of a liquid crystal display.

16. The display of claim 15, including a lenticular sheet arranged over a light output surface of the liquid crystal display.

17. The display of claim 12, wherein the first and second light directing arrangements include a plurality of light emitting devices (LEDs) and a plurality of lightguides that provide collimated light to the plurality of pixels.

18. A method of driving a display that includes a plurality of light sources arranged in rows of repeating sequences of red, green, and blue light sources, the method comprising:

displaying a frame of an image by displaying four luminance cycles, the four luminance cycles comprising:

two luminance cycles that include concurrently illuminating every other one of the light sources in a first row; and two luminance cycles that include concurrently illuminating every other one of the light sources in a second row;

wherein within the four luminance cycles, all of the light sources in each of the rows are illuminated.

19. A display comprising:

a plurality of pixels arranged in a plurality of light sources arranged in rows of repeating sequences of red, green, and blue light sources;

a controller that controls the red, green, and blue light sources to provide illumination for each frame forming an image, each frame comprising four illuminance cycles;

wherein to provide the four illuminance cycles, the controller provides:

two luminance cycles that include concurrently illuminating every other one of the light sources in a first row; and two luminance cycles that include concurrently illuminating every other one of the light sources in a second row;

wherein within the four luminance cycles, all of the light sources in each of the rows are illuminated.

20. The display of claim 19, wherein the display includes an array of pixels that receive the illumination from the plurality of light sources.

21. The display of claim 20, wherein the array of pixels are elements of a liquid crystal display.

22. The display of claim 21, including a lenticular sheet arranged over a light output surface of the liquid crystal display.

23. The display of claim 19, wherein the red, green, and blue light sources include a plurality of light emitting devices (LEDs).

24. The display of claim 19, wherein each of the light sources in the first row is separated from an adjacent light source by a separation distance, and each of the light sources in the second row are offset from a corresponding light source in the first row by half the separation distance.

* * * * *